United States Patent [19]

Kamat et al.

[11] Patent Number: 4,583,249

[45] Date of Patent: Apr. 22, 1986

[54] WAISTBAND ASSEMBLY

[75] Inventors: Dattatraya V. Kamat, Yardley; James R. Nabors, Horsham, both of Pa.

[73] Assignee: Crown Textile Company, Jenkintown, Pa.

[21] Appl. No.: 518,895

[22] Filed: Aug. 1, 1983

[51] Int. Cl.[4] ..... A41D 1/14

[52] U.S. Cl. ..... 2/220; 2/200; 2/222; 2/236

[58] Field of Search ..... 2/220, 221, 222, 223, 2/200, 236, 237

[56] References Cited

U.S. PATENT DOCUMENTS

| | | | |
|---|---|---|---|
| 2,679,648 | 6/1954 | Wendell | 2/221 |
| 2,999,246 | 9/1961 | Rowan | 2/221 |
| 3,155,986 | 11/1964 | Miller | 2/236 |
| 3,571,814 | 3/1971 | Miller | 2/236 |
| 3,886,598 | 6/1975 | Campbell et al. | 2/237 |
| 3,930,090 | 12/1975 | Campbell, Sr. et al. | 2/221 |
| 3,982,978 | 9/1976 | Carpenter | 156/72 |
| 3,987,496 | 10/1976 | Bernard | 2/220 |
| 4,070,217 | 1/1978 | Smith et al. | 156/73.2 |
| 4,146,934 | 4/1979 | Cohen | 2/220 |
| 4,168,546 | 9/1979 | O'Connor | 2/220 |
| 4,227,959 | 10/1980 | Brown | 156/575 |
| 4,415,625 | 11/1983 | Borel | 428/222 |

*Primary Examiner*—Werner H. Schroeder
*Assistant Examiner*—Mary A. Ellis
*Attorney, Agent, or Firm*—Robert C. Podwil

[57] ABSTRACT

A waistband assembly is provided including a woven stiffening strip having a smooth fused edge. The edge may be formed by an ultrasonic slitting process as the strip is made with a high thermoplastic content. Sufficient warp yarns are provided within the strip to insure adequate fusing along the edges. This prevents the fill from working its way out and thereby forming an irregularly shaped edge. A rough edge, which could damage the shell fabric of a garment, is accordingly avoided even after numerous dry cleanings. Because the edge is made from the same materials as the strip itself, it will last as long as the strip.

9 Claims, 4 Drawing Figures

WAISTBAND ASSEMBLY

BACKGROUND OF THE INVENTION

1. Field of the Invention

The field of the invention relates to a waistband construction for a garment.

2. Background of the Invention

Waistband constructions have traditionally included a relatively rigid woven strip having limited flexibility to prevent the waist portion of a garment from rolling over. Such strips are generally supplied to apparel manufacturers in considerable lengths. The manufacturer will then cut them to size and incorporate them within the garments. U.S. Pat. No. 3,155,986 discloses a waistband assembly similar to those employed in recent years.

It is important to provide good spring back capability in the weft (fill) direction of the waistband. U.S. Pat. No. 3,571,814 discusses the use of a woven fabric including a monofilament nylon weft and cotton thread in the warp. The strips are either woven on a narrow loom or cut from a broad fabric. In the latter case, the cutting operation can be conducted by cold shearing or by using a hot knife. The patent indicates that the use of either type of cutting leaves a rough edge. Even though the warp and weft may initially be bonded, the bonding material may tend to degrade after a number of launderings. This allows the monofilament weft to work its way out along the edges further contributing to the roughness thereof. Since rough edges can cause abrasion to the fabric shell and possible discomfort to the wearer, the '814 patent provides a plastisol bead which forms a finished edge for the strip.

SUMMARY OF THE INVENTION

The present invention is directed to a waistband construction having a strip for preventing roll-over and an integrally formed smooth edge which will not damage the shell fabric of a garment. The strip is preferably manufactured from materials which allow slitting via ultrasonic means to provide smooth edges without any additional steps. Since the edges or "beads" are formed from the same materials comprising the remainder of the strip, they will have the same basic characteristics thereof and will not separate therefrom or tend to degrade after laundering or dry cleaning. The ultrasonic cutting technique is particularly advantageous not only because it provides a smooth edge but also due to the fact that it does not discolor the waistband material.

DETAILED DESCRIPTION OF THE INVENTION

Figure 1:
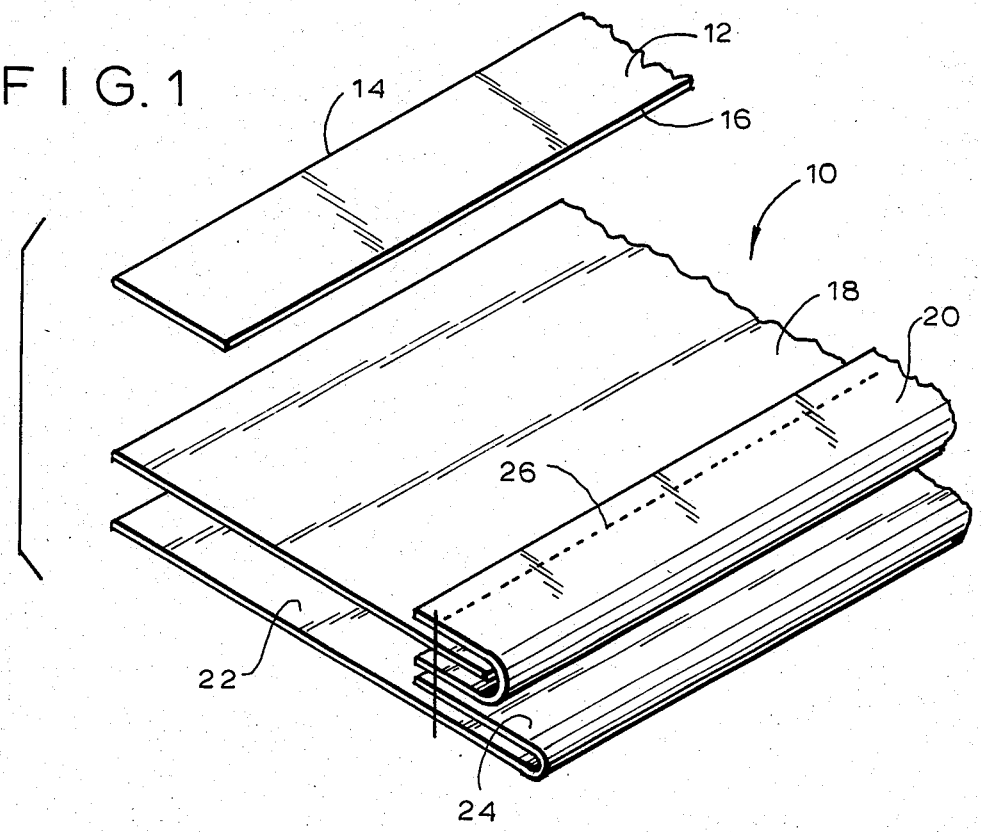
FIG. 1 is an exploded perspective view of a waistband construction according to the invention.
Figure 2:
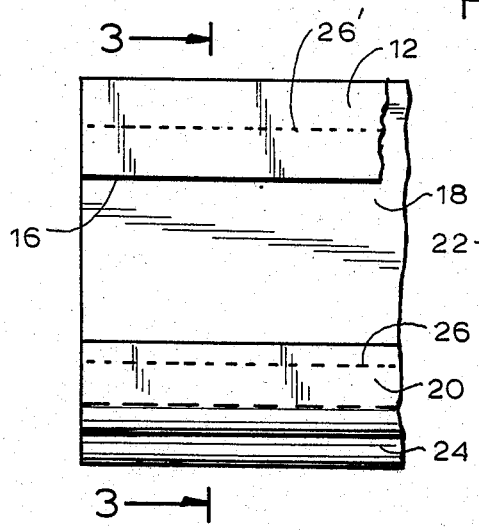
FIG. 2 is a plan view thereof.
Figure 3:
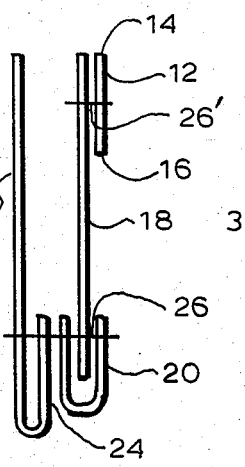
FIG. 3 is a sectional view thereof taken along the plane of line 3—3 in FIG. 2.

A waistband construction 10 according to the present invention is shown in FIGS. 1-3. It includes a woven strip 12 for stiffening the construction and preventing the waist portion of a garment from rolling over. The strip 12 includes a warp of 15.5/1 one hundred percent polyester spun yarn. In order to obtain a smooth edge as discussed hereinafter, there are about fifty-five yarns per inch of fabric.

The fill includes about twenty-five picks per inch of 1040 denier monofilament nylon. The nylon provides good spring-back capability which is important in this area. An acrylic binder or the like may be applied to the strip 12 to obtain additional firmness.

As discussed previously, rough edges on the stiffening strip of a waistband assembly can cause damage to the garment and discomfort to the wearer. The weave pattern and materials employed in the manufacture of the strip are accordingly chosen to provide a smooth edge upon the slitting and fusing thereof.

Ultrasonic slitting is a preferred method as it fuses the loose ends of the fibers and prevents unraveling. U.S. Pat. No. 3,679,526 discloses an ultrasonic slitting apparatus and discusses some of the benefits of its use.

It has been found that monofilament nylon fill forms a bead upon ultrasonic slitting. The polyester warp is also important in that it forms a smooth pair of lengthwise edges 14,16 when slit in the manner. A cotton warp would burn rather than melt and yield an inferior product. It is accordingly important to choose materials which will provide smooth strong edges without discoloration. By employing at least forty-five warp yarns per inch of fabric, a sufficient number of yarns (preferably two or more) are fused adjacent the edges during the slitting process to produce a very smooth edge which will last as long as the strip itself. The use of about fifty-five warp yarns per inch has been found to completely prevent movement of the monofilament nylon fill beyond the edges of the strip.

The waistband construction 10 may be assembled in any of a number of ways depending upon the requirements of the garment manufacturer. The stiffening strip 12 in the example provided herein is stitched to a fabric 18 comprising an open weave treated with a stiffening substance. A light weight soft open woven fabric 20 is folded about the lower edge of fabric 18. A tightly woven fabric 22 having a folded portion 24 is positioned adjacent the soft open woven fabric 20 and stitched thereto. Fabric 18 is also secured by this line 26 of stitching. Strip 12 is stitched to the upper portion of the relatively stiff woven fabric 19 along line 26'.

Figure 4:
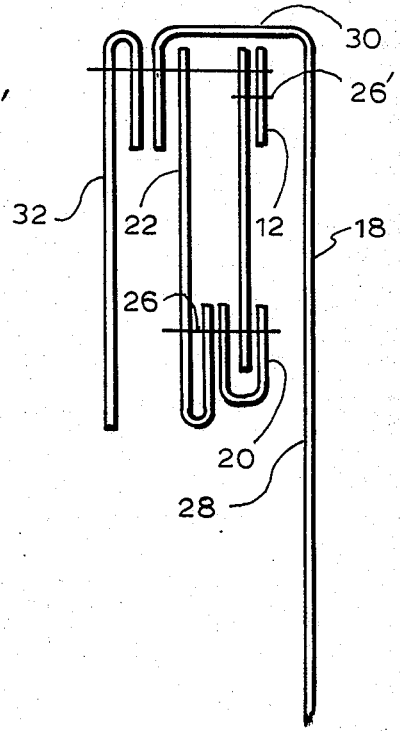
FIG. 4 is a sectional view of the waistband construction as incorporated within the waist portion of a garment.

The waistband construction 10 may be stitched to the shell fabric 28 of a garment as shown in FIG. 4. The top or waist portion of the garment is folded over the waistband construction such that the stiffening strip 12 faces outwardly and is position directly beneath the fold 30. A piece of folded interlining material 32 is stitched to the waistband construction 10 and the garment in a conventional manner.

It will be appreciated that the waistband assembly provided herein prevents the waist portion of a garment from rolling over without causing damage to the shell fabric. There is no danger of the edges or beads separating from the remainder of the stiffening strip or deteriorating after dry cleaning. Since the edges are formed from the strip material itself, they will last as long as the strip.

The materials utilizes within the waistband construction may be other than those named by way of example herein so long as they have the necessary properties required for such as application. A high thermoplastic content in the fabric comprising the stiffening strip allows the formation of smooth edges upon exposure to a high frequency energy source. A fabric passed through an array of vibrating horns and several adjustable cutting edges or anvils may be used to produce reels of waistbanding. A sufficiently high number of warp yarns per inch insures that the edges will be both strong and smooth.

What is claimed is:

1. A waistband assembly comprising:

an inwardly folded shell fabric of a garment;

a resilient, woven textile strip positioned within the fold of said shell fabric, said strip including a warp having a high thermoplastic content and comprising at least forty-five yarns per inch, a transverse fill including relatively stiff thermoplastic monofilament yarns, and at least one smooth edge positioned adjacent said fold;

said fill including about twenty-five picks per inch; and said smooth edge being formed by the fusion of at least two yarns of said warp and said yarns of said fill of said strip, said fused edge of said strip being smooth and preventing said yarns of said fill from working their way out along said smooth edge.

2. A waistband assembly as defined in claim 1 wherein said warp comprises one hundred percent polyester spun yarn.

3. A waistband assembly as defined in claim 1 wherein said warp comprises about fifty-five yarns per inch.

4. A waistband assembly comprising:

an inwardly folded shell fabric of a garment; and a resilient, woven textile strip positioned within the fold of said shell fabric, and strip including a warp having a high thermoplastic content and including 15.5/1 one hundred percent polyester spun yarn and at least forty-five yarns per inch, a transverse fill including relatively stiff monofilament fibers, said monofilament fibers being made of nylon and having about twenty-five picks per inch, and at least one smooth edge positioned adjacent said fold;

said smooth edge being formed by the fusion of at least two yarns of said warp and said yarns of said fill of said strip, said fused edge of said strip being smooth and preventing said monofilament yarns of said fill from working their way out along said edge.

5. A waistband assembly as defined in claim 4, wherein said warp comprises fifty-five yarns per inch.

6. A waistband assembly as defined in claim 4 wherein said smooth edge is ultrasonically fused.

7. A waistband assembly comprising:

an inwardly folded shell fabric of a garment;

a resilient, woven textile strip positioned within the fold of said shell fabric, said strip including a warp having a high thermoplastic content and comprising at least forty-five yarns per inch, a transverse fill including relatively stiff thermoplastic monofilament yarns, and at least one smooth edge positioned adjacent said fold;

said warp including 15.5/1 one hundred percent polyester spun yarn; and said smooth edge being formed by the fusion of at least two yarns of said warp and said yarns of said fill of said strip, said fused edge of said strip being smooth and preventing said yarns of said fill from working their way out along said smooth edge.

8. A waistband assembly comprising:

an inwardly folded shell fabric of a garment;

a resilient, woven textile strip positioned within the fold of said shell fabric, said strip including a warp having as high thermoplastic content and comprising at least forty-five years per inch, a transverse fill including relatively stiff thermoplastic monofilament yarns, and at least one smooth edge positioned adjacent said fold;

said monofilament yarns being made of nylon;

said fill including about twenty-five picks per inch; and said smooth edge being formed by the fusion of at least two yarns of said warp and said yarns of said fill of said strip, said fused edge of said strip being smooth and preventing said yarns of said fill from working their way out along said smooth edge.

9. A waistband assembly comprising:

an inwardly folded shell fabric of a garment;

a resilient, woven textile strip positioned within the fold of said shell fabric, said strip including a warp having a high thermoplastic content, a transverse fill including relatively stiff thermoplastic monofilament yarns, and at least one smooth edge positioned adjacent said fold;

said smooth edge comprising at least two fused yarns of said warp with said yarns of said fill of said strip fused to said fused yarns of said warp, said fused yarns of said warp preventing said yarns of said fill from working their way out along said smooth edge;

the fiber densities of said warp and said fill being such that cutting of said strip by ultrasonic means in the direction of said warp causes said fusion of said yarns of said warp and said fibers of said fill.

* * * * *